United States Patent [19]

Donnelly

[11] 4,058,952

[45] Nov. 22, 1977

[54] EXPANSION OF BUILDING STRUCTURE

[76] Inventor: Frank R. Donnelly, P.O. Box 218, Dover, N.J. 07801

[21] Appl. No.: 722,693

[22] Filed: Sept. 13, 1976

[51] Int. Cl.[2] ..... E04B 1/00

[52] U.S. Cl. ..... 52/741; 52/126; 52/749

[58] Field of Search ..... 52/741, 749, 745, 126, 52/66

[56] References Cited

U.S. PATENT DOCUMENTS 3,828,513 8/1974 Vanderklaauw ..... 52/745

*Primary Examiner*—Price C. Faw, Jr.
*Assistant Examiner*—Carl D. Friedman

[57] ABSTRACT

A building structure is expanded by extending the vertical support columns such that the roof structure is raised at least one story, and a floor structure is capable of being mounted in a position substantially intermediate the ground level and raised roof level.

16 Claims, 17 Drawing Figures

FIG. 6
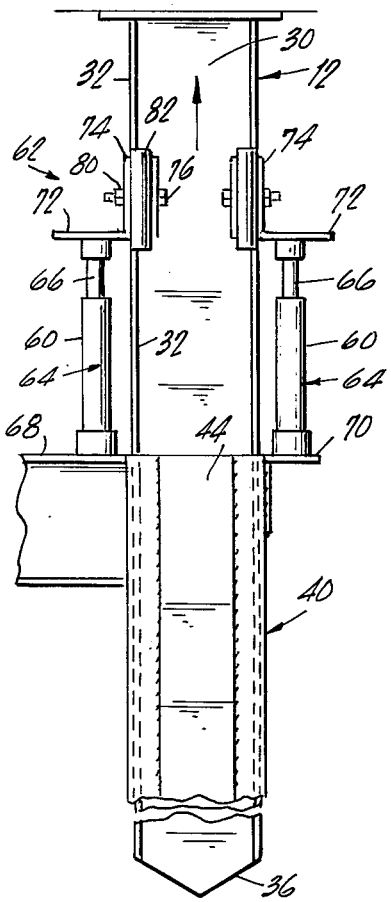
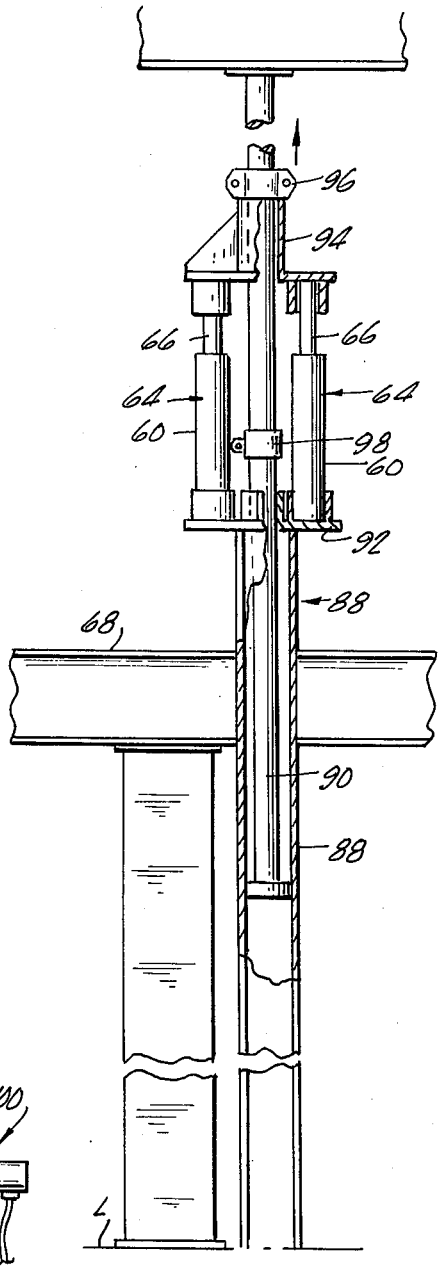
FIG. 7
FIG. 8
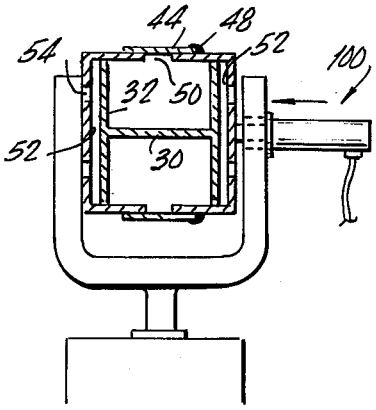
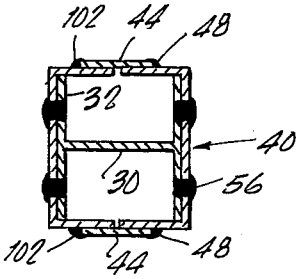
FIG. 9

EXPANSION OF BUILDING STRUCTURE

BACKGROUND OF THE INVENTION

With the spiraling cost of land and new building construction, a need has arisen to expand existing building structures. In accordance with the present invention, it is possible to extend the roof of a building structure in order to obtain additional space. Thus, through the present invention, it is possible to take advantage of the existing structure and land use and increase the usable floor space to as much as double the original capacity. This expansion capability can be built into new structures for future expansion purposes of retrofiltered into existing structures requiring immediate expansion. The hydraulic lifting and telescopic column system of the present invention, affords the capability of expanding a building structure, at far less cost and time than is required to build a new separate or adjoining structure. Also, a commercial structure can be expanded with a minimum disruption to the normal working routine and additional working or storage space can be obtained very quickly. The present invention, in addition to being used for adding a story to a building, can also be used to increase the head space in a factory or warehouse. Thus, instead of placing a floor under the raised roof to essentially double the floor space, it is possible to leave out the floor and increase the head space in accordance with new needs requiring greater roof heights. Accordingly, the present invention affords an economic and logical approach to commercial expansion, while overcoming obstacles such as increasing expansion costs, zoning problems, construction bans, and disruption to personnel.

SUMMARY OF THE INVENTION

In accordance with illustrative embodiments demonstrating features and advantages of the present invention, there is provided an apparatus and method for extending the height of a building formed from support members including columns which are vertically oriented with respect to ground level and a roof structure is supported on the columns. The apparatus of the present invention comprises means for forming a transverse break through each of the columns. Guide means associated with the columns surround the transverse break and extend along the length of the columns to a position below the roof structure. Means for raising the columns above the transverse break are mounted on the guide means in contact with the columns above the transverse break. The method of the present invention comprises the steps of cutting through each of the columns to form a transverse break and then surrounding the columns with guiding means for maintaining the columns in a vertical orientation with respect to the ground level. Thereafter, the method comprises the steps of raising the columns and the roof structure upwardly above the transverse break. Thus, in accordance with the apparatus and method aspect of the present invention, the height of the building structure is substantially extended whereby a floor structure is capable of being mounted to the support members in a position which is substantially intermediate the ground level and the raised roof level.

BRIEF DESCRIPTION OF THE DRAWINGS

The above brief description, as well as further objects, features, and advantages of the present invention, will be more fully appreciated by reference to the following detailed description of presently preferred but nonetheless illustrative embodiments in accordance with the present invention, when taken in connection with the accompanying drawings wherein:

FIG. 6 is a partial elevational view of the telescopic vertical column with lifting jacks shown in a raised position;

FIG. 7 is an elevational view of a temporary exterior columns provided for location around the periphery of the building structure;

FIG. 8 is a transverse sectional view of a hydraulic clamp positioned on the box structure for forcing it together around the telescopic column;

FIG. 9 is a transverse sectional view showing the box structure forced together and welded to the telescopic column;

DESCRIPTION OF THE PREFERRED EMBODIMENTS

Figure 1:
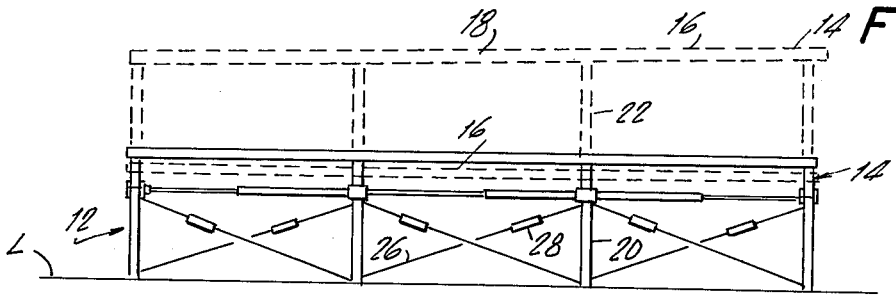
FIG. 1 is a front elevational view of a building structure with the broken line view showing the extended section in accordance with the present invention.

With reference to FIG. 1 there is shown a building structure generally designated by the reference numeral 10 and formed with support columns 12 that are vertically oriented and mounted above ground level, which has been designated by the reference letter L. The building structure 10 is shown with a roof structure 14 in an initial position prior to expansion and in a fully raised position after expansion, which have been designated 16 and 18, respectively. The columns 12 are shown in an initial position 20 prior to expansion with the roof structure 14 mounted thereon in the initial position 16 and in a fully raised position 22 after expansion with the roof structure 14 mounted thereon in the fully raised position 18.

When the roof structure 14 has moved into the fully raised position 18, a floor structure 24 can be mounted on the support columns 12 in a position substantially intermediate ground level L and the fully raised position 18. To aid in maintaining the building structure 10 in an upright position, guide wires 26 with adjustment turnbuckles 28 are diagonally secured to adjacent columns 12.

The column 12 is preferably of an I-beam construction consisting of a center web section 30 integrally formed with a pair of opposing web flanges 32. By progressively inspecting FIGS. 2 and 2A, it can be appreciated that support column 12 is formed with a transverse break 34 which includes a V-shaped cut 36 on center web section 30 and a pair of V-shaped cuts 38 on web flanges 32. The V-shaped cuts 36 and 38 are preferably made at an angle of approximately 30° with respect to the horizontal axis of the column 12. As shown by the broken line between FIGS. 2 and 2A, the top of the cut 36 is at the same level as the lower most portion of the cut 38, such that a complete transverse break 34 is formed across the column 12. Accordingly, the V-shaped cuts 36 and 38 serve as a means for retaining the column 12 in a vertically oriented load-bearing position, even though the column 12 is completely severed by the transverse break 34.

Figure 2:
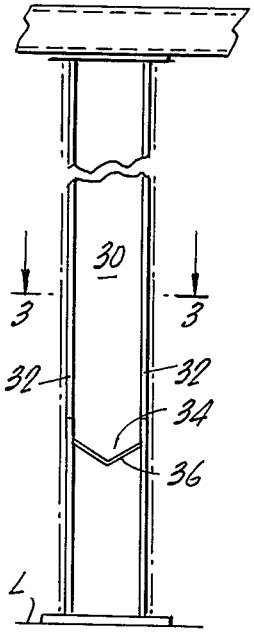
FIGS. 2 and 2A are respective front and side elevational views of a vertical column in which a transverse break has been made and a box structure has been positioned to surround the vertical columns.
Figure 2A:
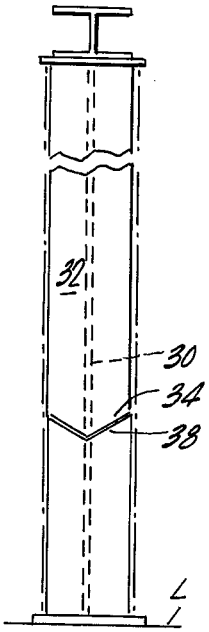
Figure 3:
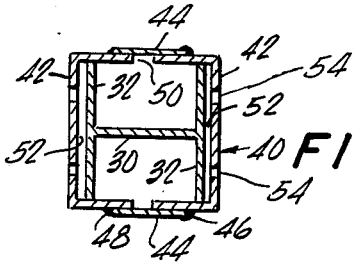
FIG. 3 is a transverse sectional view of the vertical column of FIGS. 2 and 2A, showing the welded joints for securing the box structure.

By progressively comparing FIGS. 2 and 3, it can be seen that an outer column structure 40 is provided to surround the support columns 12. The outer column structure 40 serves as guide means for maintaining the columns 12 in a vertical orientation with respect to the ground level L as the roof structure 14 is moved into the fully raised position 18. Furthermore, as will be more fully described, the outer column structure 40 is used for securing the support columns 12 when they have been moved into the fully raised position 22.

The outer column structure 40 is formed from a pair of channel supports 42, which are secured by means of a pair of plates 44 that are mounted on opposite sides of the channel supports 42 by means of a permanent weld 46 and a temporary weld 48. In this manner, the adjacent marginal edges of channel supports 42 are separated to form a longitudinal space 50. As best shown in FIG. 3, the channel supports 42 are positioned to surround the support columns 12, such that there is a pair of open spaces 52 between the channel supports 42 and web flanges 32. Movement of the support columns 12 above the transverse break 34 is afforded by the open spaces 52. When the support columns 12 have been moved to fully raised position 22, the open spaces 52 are reduced, after removing the temporary welds 48, as will be more fully described.

Figure 4:
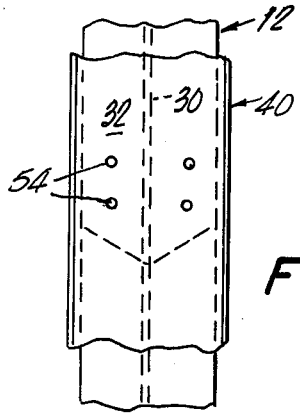
FIG. 4 is a partial elevational view of the vertical column showing the plug holes for securing the column in the raised position.

As shown in FIG. 4, plug holes 54 are bored in the channel supports 42 in a position overlying the web flanges 32. The plug holes 54 are provided to secure support columns 12 to the outer column 40 after achieving the fully raised position 22. This is accomplished by the plug welds 56 of FIG. 9, which are formed by welding rod material in the plug holes 54.

Figure 5:
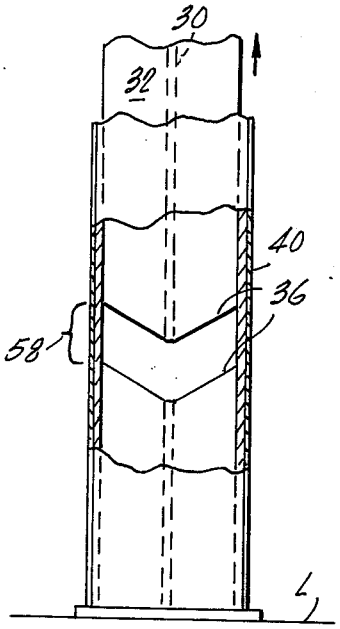
FIG. 5 is a partial elevational view of the vertical column showing the telescopic action of the column as it is being raised.

By referring to FIGS. 5 and 6, a perspective can be gained of the movement of the support columns 12 within the outer column structure 40. Thus, the building structure 10 is raised by telescopically raising the support columns 12 above transverse V-shaped cut 36, such that an enlarged space 58 is formed. Accordingly, as the support columns 12 are moved to the fully raised position, the enlarged space 58 will increase. As shown in FIG. 6, the support columns 12 are raised by means of lifting jacks 60, and lifting brackets 62 are secured to the columns 12 so as to be in contact with lifting jacks 60.

Figure 10:
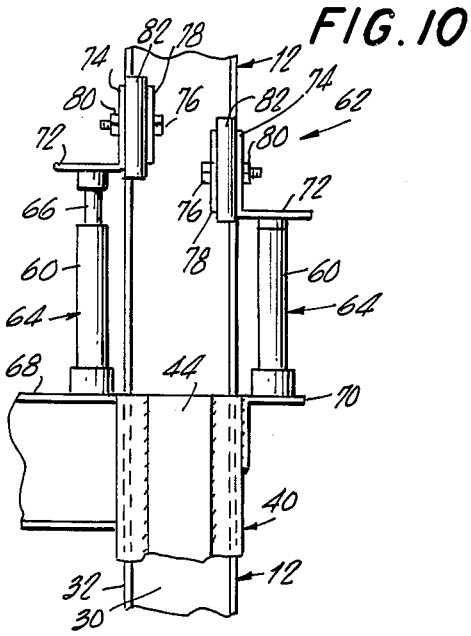
FIG. 10 is a partial elevational view of the column showing one of the lifting jacks in a retracted position.

By turning to FIG. 10, it can be seen that the lifting jacks 60 include a cylinder base 64 in which a piston 66 is mounted. It is intended that the lifting jacks 60 shall be standard commercial hydraulic jacks having a lifting capacity in the neighborhood of 30 tons. The lifting jack 60 shown in the raised position in FIG. 10 is mounted on a horizontal beam 68 which will become part of the second story floor structure, while the other lifting jack 60 is mounted on a support bracket 70. The horizontal beam 68 and support bracket 70 are welded to the outer column structure 40 at the upper end thereof. Thus, it can be appreciated that the support column 12 of FIG. 10 is located at outermost periphery of building structure 10. Accordingly, it can be seen that the support bracket 70 would not be necessary in connection with the raising of support columns 12 located inside the outer perimeter of building structure 10, as both lifting jacks 60 could then rest on the horizontal upper floor structure, such as the beam 68.

Figure 13:
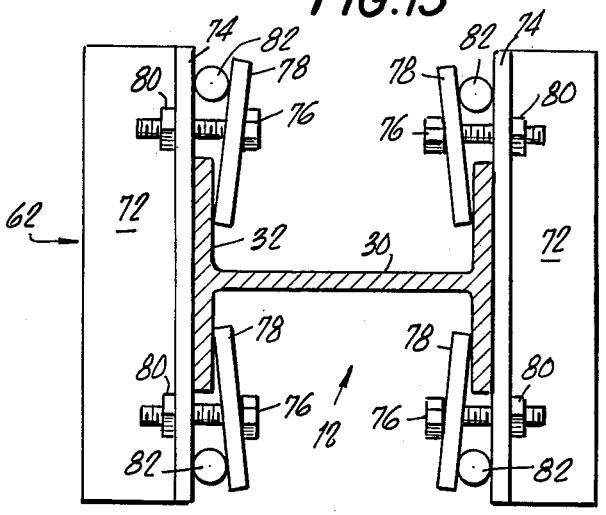
FIG. 13 is an enlarged transverse sectional view of the lifting brackets shown in FIG. 12.

The construction of lifting brackets 62, which is best shown in FIG. 13, includes an integrally formed horizontal shelf 72 and vertical wall 74, having an L-shaped cross-sectional configuration. The lifting brackets 62 are sized to extend beyond the side marginal edges of each of the web flanges 32, such that a pair of through bores can be formed in vertical wall 74 for receiving fastening bolts 76. A mounting plate 78 is also provided with a similar through bore for receiving the fastening bolt 76 which is capable of being threadably engaged with a nut 80. In order to securely fasten the lifting plates 62 to the support column 12, a cylindrical shim 82 is positioned between mounting plate 78 and vertical wall 74. In this manner, by tightening the nuts 80 on fastening bolts 76, the vertical walls 74 can be securely mounted on the web flanges 32, such that the lifting brackets 62 are capable of supporting the load of support columns 12 above transverse break 34.

Figure 11:
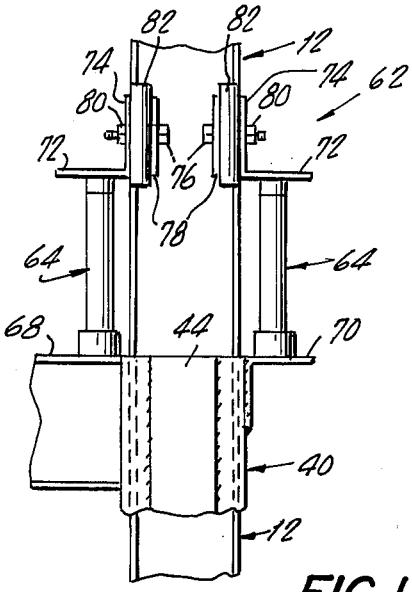
FIG. 11 is a partial elevational view of a telescopic column showing both of the lifting jacks in a retracted position.
Figure 12:
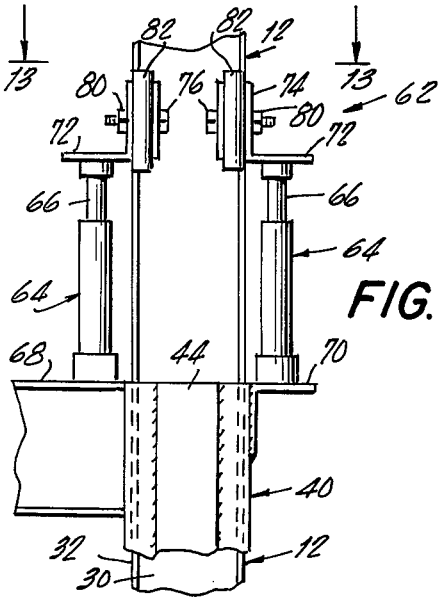
FIG. 12 is a partial broken elevational view of the telescopic columns showing the adjustable lifting brackets with the lifting jacks in a raised position.

By progressively inspecting FIGS. 11, 12, and 10, the operational sequence of the lifting jacks 60 can be more readily appreciated. Accordingly, in FIG. 11, the lifting jacks 60 are shown prior to the upward movement of the load of building structure 10. In FIG. 12, the lifting jacks 60 are shown in a load lifting mode with both of the pistons 66 extending outward from the cylinders 64. In FIG. 10, the lifting jacks 60 are shown at the initiation of the load release mode, which includes releasing and lowering one of the lifting brackets 62 and associated piston 66, such that the other lifting bracket 62 and associated piston 66 support the entire load of the column 12. This is possible, since each lifting jack 60 is provided with a load carrying capacity safety factor that is several times the load on an individual support column 12. Thus, the lifting bracket 62 of FIG. 10 which has been slid downward by threadably disengaging the fastening nuts 80 from bolts 76, can be resecured by tightening the nuts 80. In this manner the lifting jack 60 of FIG. 10, which is in the raised position, can be lowered, and the associated lifting bracket 62 can be slid downward to the starting position shown in FIG. 11. The raised lifting bracket 62 of FIG. 10 that has been lowered to the initial position shown in FIG. 11 can be secured to the column 12 by threadable engagement of the nuts 80 and fastening bolts 76, as previously outlined above. From the foreging, it can be appreciated that when the second lifting jack 60 is being lowered, the first lifting jack 60 that already has been placed in the lowered position takes up the load transmitted by the support column 12. The above procedures can be repeated, such that the support columns 12 are telescopically moved upward above transverse break 34, with a resultant corresponding increase in the enlarged space 58. It should be understood that it is preferable to accomplish each sequence of upward movement of all of the columns 12 in unison. This can be achieved through the use of a hydraulic control system, generally designated 84 in FIG. 16, which is operatively connected to the lifting jacks 60 for raising all of the lifting jacks 60 in unison.

Before discussing in detail the operation of the hydraulic control system 84, several other features of the present invention should be considered. Accordingly, a number of temporary columns 86 have been provided around the outer periphery of building structure 10. As shown in FIG. 7, the temporary columns 86 include a cylindrical base 88 in which a piston 90 is slidably engaged. A support bracket 92 is fixed to the cylindrical base 88 for mounting the lifting jacks 60, and a lifting collar 94 is slidably mounted on the piston 90 above the lifting jacks 60. The piston 90 is also engaged by upper clamp 96 and lower clamp 98. Prior to the initial operation of temporary columns 86, the lower clamp 98 is contacted with the top of cylinder 88 such that the load is transmitted from the piston 90 to the cylinder 88 by means of lower clamp 98. As the temporary columns 86 move into the upward mode shown in FIG. 7, the lower clamp 98 is spaced apart from the top edge of cylinder 88 and the load is transmitted upward by the lifting jacks 60, first to lifting collar 94, then to the upper collar 96, and finally to the piston 90. When the pistons 66 of lifting jacks 60 reach their uppermost limit of extension, the lower clamp 98 is slid downward and secured against the top of cylinder 88. In this manner, the lower clamp 98 is in a position to support the load when upper clamp 96 is released, thereby allowing the lifting jacks 60 to be moved downward and thereafter resecured. Thus, the temporary columns 96 can be operated sequentially in a series of upward movements, similar to the upward movement of the permanent support columns 12, with the maximum amplitude of each upward extension of the building structure 10 being governed by the maximum stroke of the lifting jacks 60.

When all of the columns 12 have been moved into the fully raised position 22, the outer column structure 40 is permanently secured to the columns 12. As shown in FIG. 8, this is achieved by positioning a hydraulic clamp 100 on the channel supports 42 in a position overlying the open spaces 52. Thereafter, the temporary weld 46 is removed by a burn-off procedure, and the hydraulic clamp 100 is activated in order to compress together the channel supports 42 in the position shown in FIG. 9. A permanent column structure is obtained by forming a permanent weld 102 along the marginal edge of plate 44 opposite weld 48. Also, after the clamp 100 has been activated, the plug welds 56 are made through the plug holes 54 to transmit the load from the beam 12, above the transverse break 34, to the outer column structure 40.

Figure 14:
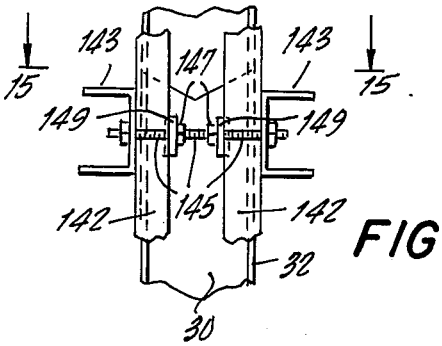
FIG. 14 is a partial elevational view of a further embodiment of the outer column structure.
Figure 15:
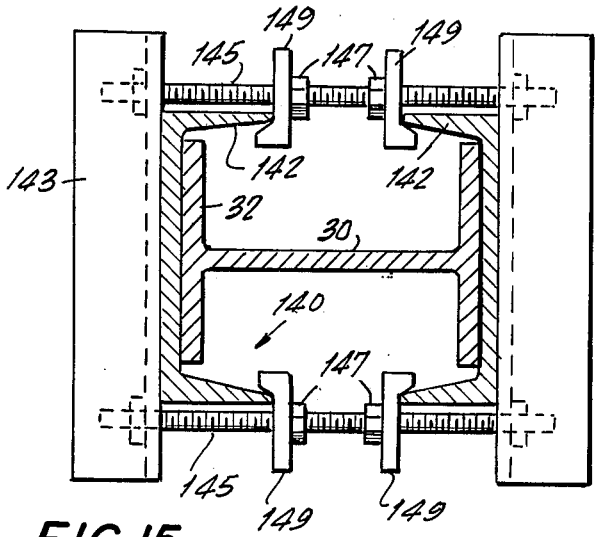
FIG. 15 is an enlarged transverse sectional view of the embodiment of the outer column structure shown in FIG. 14.

In FIGS. 14 and 15, there is illustrated a further embodiment of the invention in which corresponding parts have been designated by the same reference numerals as part of a "100" series. There is provided an adjustable outer column structure 140 which comprises a pair of channel supports 142, that are sized to engage the support columns 12. As shown in FIG. 14, a pair of clamping units 143, having a U-shaped cross-section are provided to maintain the channel supports 142 in a fixed position. This is achieved by forming aligned through bores on the outermost opposite sides of the clamping units 143. The through bores receive threaded shafts 145 which are engaged by fastening nuts 147. A clamping plate 149 is mounted on shaft 145 and is brought into contact with the outer edge of channel support 142 by the fastening nuts 147. As shown in FIG. 14, there are four pairs of fastening nuts 147 positioned at the corners of clamping units 143. Pressure can be exerted on the channel supports 142 by tightening each pair of fastening nuts 147.

It is contemplated that three clamping units 143 will be used for each adjustable outer column structure 140, such that a first and second clamping unit 143 can be respectively located at the bottom and top of outer column structure 140, and a third clamping unit 143 can be located in a position substantially intermediate the first and second clamping units 143. In this manner, it is possible to adjust the pressure of the clamping units 143 against outer column support 140 and the associated web flange 32, such that it is possible to facilitate the sliding action of the support column 12 above transverse break 34 during the raising of the building structure 10, as has been previously described. Also, the upper clamping unit 143 may be used as a base for supporting the lifting jacks 60, in a manner similar to the support bracket 70. When the support columns 12 are in the fully raised position 22, the same procedure involving the plug welds 56 is used to secure the channel supports 143 to the web flanges 32. After the plug welds 56 have been accomplished, the clamping units 143 can be removed and the plates 44 can be welded to the channel supports 142 in a manner similar to the support column 12 which has been shown in FIG. 9.

Figure 16:
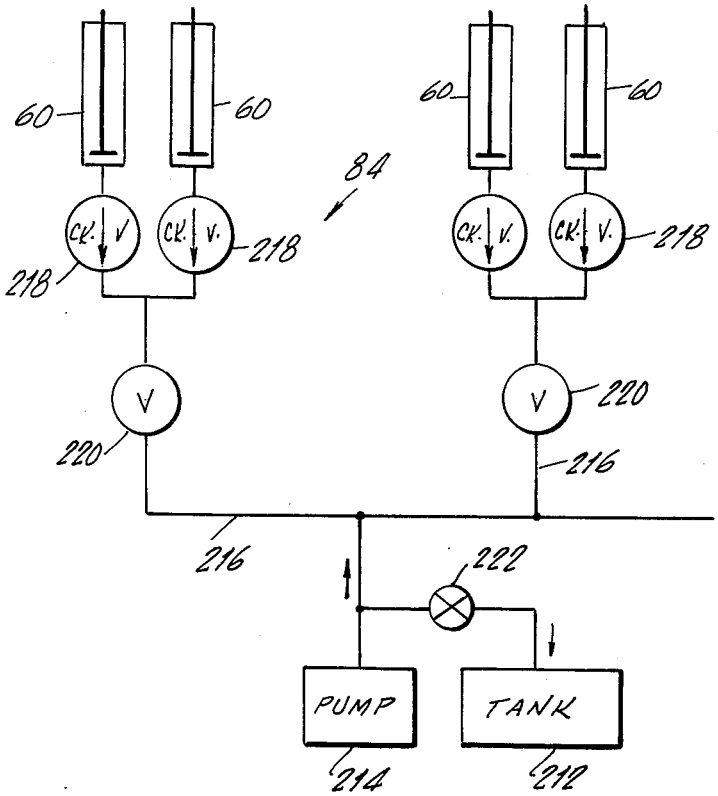
FIG. 16 is a schematic representation of the hydraulic system for raising and lowering the lifting jacks.

In order to achieve simultaneous operation for all of the lifting jacks 60, the hydraulic control system 84 is provided. Turning to FIG. 16, the hydraulic control system 84 includes a tank 212 connected to a pump 214. Fluid lines 216 are provided for placing the tank 212 and pump 214 in flow communication with the lifting jacks 60. Each pair of lifting jacks 60 is provided with a pair of check valves 218 in fluid lines 216, and flow control valves 220 are placed in fluid lines 216 between the pump 214 and check valves 218. Also, a by-pass valve 222 is placed in fluid lines 216 between the tank 212 and pump 214. It should be understood that for the sake of simplicity, only two sets of lifting jacks 60 have been shown connected in fluid lines 216, but it should be understood that the hydraulic control system 84, shown in FIG. 16, is intended for use with a plurality of sets of lifting jacks 60, connected in the same manner.

In a typical sequence of operation for expanding the building structure 10, after the transverse breaks 34 have been made in all of the support columns 12, the lifting jacks 60 are placed in the initial position shown in FIG. 11. The pump 214 is then activated and fluid flows from tank 212 through the lines 216 into the cylinders 64 of lifting jack 60. The proper constant operating pressure for each cylinder 64 is maintained by means of the pressure compensating valve 220. Thus, the pistons 66 of the lifting jacks 60 will reach their maximum stroke limit, and the pump 214 can be cut off by either a manual system or an automatic system. The manual cut-off system contemplates shutting down the pump 214 based on a visual indication from an operator that the pistons 66 have reached their stroke limit. The automatic shut-off system would require a standard pressure operated valve system or limiting switch device for automatically shutting down the pump 214, based on a maximum pressure which would be reached when the piston 66 is at full stroke. In connection with either the automatic or manual shut-off systems, it is desirable to have a hand operated pump available which can easily be attached to individual lifting jacks 60 to upwardly adjust the height of piston 66, such that the building structure 10 is fully and uniformly raised during each lifting sequence. After the pump 214 has been cut off when the pistons 66 are in the full stroke position, by-pass valve 222 is opened, thereby allowing the fluid to pass downstream of the check valves 218 and return to the tank 212. The check valves 218 maintain the fluid under pressure in the cylinders 66 upstream of the check valves 218. The procedure for releasing the pistons 66 requires that one of the check valves 218 of each set be opened, thereby allowing the fluid to pass through the fluid lines 216 into the tank 212, such that the piston 66 can be brought to the lowermost position, as shown in FIG. 10. This general approach is followed in connection with one lifting jack 60 of each pair. After the lowermost lifting bracket 62 has been slid downward and secured to the column 12, as shown in FIG. 10, the other check valve 218 is released, thereby allowing the fluid from the raised lifting jack 60 to return to the tank 212. Accordingly, the raised lifting bracket 62 and piston 66 of FIG. 10 can be slid downward to the position shown in FIG. 11.

It can be appreciated that in accordance with the present invention, a method and apparatus have been provided for extending the height of the building structure 10, by means of a hydraulic control system 84 which allows for the raising and lowering of a plurality of lifting jacks 60 which are operatively connected to the support columns 12 above the transverse break 34. Thus, it is possible to sequentially raise the roof structure 14 from the initial position 16 to the fully raised position 18. As has been described herein, the vertical columns 12 above transverse break 34 can then be permanently fixed to the outer column structure 40, such that a second level floor structure 24 is capable of being positioned substantially intermediate the ground level L and the raised roof level 18.

A latitude of modification, change, and substitution is intended in the foregoing disclosure, and, in some instances, some features of the invention will be employed without corresponding use of other features. Accordingly, it is appropriate that the appended claims be construed broadly and in a manner consistent with the spirit and scope of the invention herein.

What is claimed is:

1. A method of extending the height of a building structure, formed from support means including columns which are vertically oriented with respect to ground level and a roof structure supported on said columns, comprising the steps of:

cutting through each of said columns to form a transverse break;

surrounding said columns with guiding means for maintaining said columns in a vertical orientation with respect to said ground level;

raising said columns and said roof structure upwardly above said transverse break such that the height of said building structure is substantially extended; and fastening said vertical columns which have been raised to said guiding means, whereby a floor structure is capable of being mounted to said support members in a position which is substantially intermediate said ground level and the raised roof level.

2. The method of extending the height of a building structure according to claim 1 in which said guide means includes an outer structure which surrounds each column such that said column is capable of telescopically sliding upward within said outer structure above said transverse break.

3. The method of extending the height of a building structure according to claim 2 in which each of said columns are raised by a pair of jacks positioned in lifting contact with each of said columns above said transverse break.

4. The method of extending the height of a building structure according to claim 3 in which lifting plates are slidably mounted on said columns above said transverse break, each pair of lifting jacks contacting a pair of said lifting plates for raising said columns upwardly above said transverse break.

5. The method of extending the height of a building structure according to claim 4 in which said columns are raised by extending said pistons to a full stroke position, then releasing one lifting plate and one lifting jack of each of said pairs such that the load is supported by the other lifting jack and associated lifting plate of each of said pairs, then moving the released lifting plate and lifting jack downwardly such that the release piston is fully retracted and in contact with the released lifting plate, then securing the released lifting plate to said column such that the released lifting jack is capable of supporting the load transmitted from the newly secured lifting plate upon release and retraction of the other lifting jack and lifting plate of said pair.

6. The method of extending the height of a building structure according to claim 3 in which a hydraulic control system is placed in flow communication with the base cylinders of said lifting jacks, such that the pistons of all of said lifting jacks are raised together in unison by the fluid pressure of said hydraulic control system which is transmitted to said pistons.

7. Apparatus for extending the height of a building comprising:

columns which are vertically oriented with respect to ground level;

a roof structure supported on said columns;

each of said columns having a transverse break;

each of said columns including a lower column and an upper column separated by said transverse break;

guide means associated with said lower column and said upper column surrounding said transverse break above and below said transverse break and extending along the length of said lower column and said upper column to a position below said roof structure such that said guide means maintains said upper column in vertical alignment with respect to said lower column; and means on said guide means contacting said upper column above said transverse break for raising said upper column above said transverse break such that the height of the building structure is substantially extended at least one story, whereby a floor structure is capable of being mounted to said support members in a position which is substantially intermediate said ground level and the raised roof level.

8. Apparatus for extending the height of a building according to claim 7 in which said guide means includes a pair of spaced-apart elongated channel supports for receiving said columns such that said upper column is capable of telescopically sliding upward within said outer hollow structures above said transverse break.

9. Apparatus for extending the height of a building structure according to claim 8 in which a plurality of adjustable clamping units engage said channel supports for maintaining said channel supports in a fixed position.

10. Apparatus for extending the height of a building structure according to claim 15 in which each of said clamping units includes means for threadable engagement, such that each of said pairs of channel supports can be compressed inwardly against each of said columns.

11. Apparatus for extending the height of a building according to claim 8 in which said means on said guide means for contacting said columns includes a pair of lifting jacks for each of said columns, each of said lifting jacks having a base cylinder mounted on said outer hollow structures and a movable piston in lifting contact with each of said columns above said transverse break.

12. Apparatus for extending the height of a building according to claim 11 in which lifting plates are slidably mounted on said columns above said transverse break, each pair of lifting jacks contacting a pair of said lifting plates, such that said columns are capable of being raised upwardly above said transverse break.

13. Apparatus for extending the height of a building according to claim 11 in which a hydraulic control system is placed in flow communication with the base cylinders of said lifting jacks, such that the pistons of all of said lifting jacks are capable of being raised together in unison by the fluid pressure of said hydraulic control system which is transmitted to said pistons.

14. Apparatus for extending the height of a building according to claim 11 in which said hydraulic control system comprises, a tank for maintaining a supply of hydraulic fluid, a pump in flow communication with said tank, said base cylinders of the lifting jack in flow communication with said pump, and check valve means positioned between said base cylinders and said pump, such that on disengagement of said pump said hydraulic fluid downstream of said check valve means returns to said tank and said hydraulic fluid upstream of said check valve means is maintained under pressure to support said lifting jacks.

15. Apparatus for extending the height of a building according to claim 12 in which by-pass valve means is positioned in between said check valve means and said tank, such that the pressure on each of said lifting jacks can be released by shutting off said pump opening said by-pass valve means and said check valve means.

16. Apparatus for extending the height of a building according to claim 7 in which said transverse break is in the form of a downwardly extending V-shaped cut such that said upper column is maintained in an initial upright position prior to extending the height of said building.

* * * * *